US006048099A

United States Patent [19]

Muffett et al.

[11] Patent Number: 6,048,099

[45] Date of Patent: Apr. 11, 2000

[54] SOFT-SIDED INSULATED CONTAINER

[75] Inventors: Dorothy J. Muffett, Plymouth, Minn.; John F. Bald, Sandy, Utah; Michael H. Miller, Edina, Minn.

[73] Assignee: Thermo Solutions, Inc., Minneapolis, Minn.

[21] Appl. No.: 09/190,540

[22] Filed: Nov. 12, 1998

Related U.S. Application Data

[60] Provisional application No. 60/065,141, Nov. 12, 1997.

[51] Int. Cl.[7] ..... B65D 33/06; B65D 30/14

[52] U.S. Cl. ..... 383/20; 383/80; 383/110; 383/113; 383/121.1

[58] Field of Search ..... 383/110, 20, 113, 383/121, 121.1, 80, 84, 86, 98, 99

[56] References Cited

U.S. PATENT DOCUMENTS

| | | | |
|---|---|---|---|
| 1,369,448 | 2/1921 | McNab . | |
| 1,971,395 | 8/1934 | Danner | 383/110 X |
| 2,554,215 | 5/1951 | Schell et al. . | |
| 2,667,198 | 1/1954 | Klein . | |
| 2,731,182 | 1/1956 | Higgins . | |
| 2,808,093 | 10/1957 | Gilman | 383/80 X |
| 3,031,121 | 4/1962 | Chase . | |
| 3,428,103 | 2/1969 | Walsh . | |
| 3,583,459 | 6/1971 | Nappe | 383/110 |
| 3,589,971 | 6/1971 | Reed | 383/110 X |
| 4,211,267 | 7/1980 | Skovgaard . | |
| 4,286,745 | 9/1981 | Fukuoka . | |
| 4,497,859 | 2/1985 | Baumann . | |
| 4,509,645 | 4/1985 | Hotta . | |
| 4,537,313 | 8/1985 | Workman . | |
| 4,578,814 | 3/1986 | Skamser . | |
| 4,679,242 | 7/1987 | Brockhaus . | |
| 4,730,748 | 3/1988 | Bane . | |
| 4,746,019 | 5/1988 | Prater . | |
| 4,759,077 | 7/1988 | Leslie . | |
| 4,765,476 | 8/1988 | Lee . | |
| 4,802,233 | 1/1989 | Skamser . | |
| 5,028,087 | 7/1991 | Ells . | |
| 5,090,526 | 2/1992 | Jacober . | |
| 5,147,067 | 9/1992 | Effertz . | |
| 5,190,376 | 3/1993 | Book . | |
| 5,201,868 | 4/1993 | Johnson . | |
| 5,346,309 | 9/1994 | Book . | |
| 5,429,264 | 7/1995 | Hollander et al. . | |
| 5,490,396 | 2/1996 | Morris . | |
| 5,857,778 | 1/1999 | Ells . | |

OTHER PUBLICATIONS

Thermal Bags by Ingrid, Inc. Price List, (1994).

(List continued on next page.)

*Primary Examiner*—Jes F. Pascua
*Attorney, Agent, or Firm*—Kinney & Lange, P.A.

[57] ABSTRACT

A soft-sided insulative container includes a base, a rear wall and three side walls extending upward from the base, and a cover. The base, rear wall and cover are integrally formed, with the cover connected to the rear wall with a folding hinge. The side walls are integrally formed with each other, with the side walls connected to the base and rear wall at seams. Each side wall has a side wall ear flexibly attached to it with a folding hinge to extend inward adjacent the cover. The cover has cover ears each flexibly attached to it with a folding hinge, and cover ears extend downward around all the peripheral edges of the cover. In a closed position, each unhinged edge between the cover and the side walls includes both a side wall ear and a cover ear in an overlapping configuration. The cover ears are temporarily secured to the side walls in this closed position. The base, the side walls, the cover, the side wall ears and the cover ears are formed of three layers of flexible material, including an inside layer, an outside layer, and a thermally insulative blanket. The inside layer and the outside layer are substantially waterproof. The insulation blanket includes four separate layers, which extend continuously through the flexible hinges, but do not extend into seams.

15 Claims, 8 Drawing Sheets

OTHER PUBLICATIONS

Donovan Enterprises, Inc. Raise The Standard Fleet Price List, (Jul. 1996).
InterPac Systems, Inc. The Pal–Pac Pallet Wrap System Brochure.
Climax Industries Product Information and Custom Options and Instulated Price Lists, (1994).
Speedwall Portable Refrigeration Barrier Systems by Inter/Pac Systems brochure.
Speedwall Portable Refrigeration Barrier System by Ancra International.
Ancra International Pal–Pac brochure.

10

40
18
26b
26a
26b
38
26b
30
30
20
22
36
16
16
48
42
44
12
20

42
44
54
52
42
52
54
44
60
58
56
62
58
64

SOFT-SIDED INSULATED CONTAINER

CROSS-REFERENCE TO RELATED APPLICATION(S)

This application claims the benefit of provisional application No. 60/065,141 filed on Nov. 12, 1997, entitled SOFT-SIDED INSULATED CONTAINER.

BACKGROUND OF THE INVENTION

The present invention relates to thermally insulated containers, and, more particulary, to insulated containers which are not rigid but rather have soft, flexible sides.

Soft-sided insulated containers have a number of advantages over rigid thermally insulated containers. Soft-sided insulated containers can be compressed such as when not in use, or deformed to fit into a particular size of opening. If a soft-sided insulated container is dropped or collides against other objects, less damage will generally occur, both to the contents of the container and to the object(s) collided against. Soft-sided insulated containers are generally lightweight. Despite use which may involve rigorous wear and tear, soft-sided insulated containers can be made durable and attractive for an extended period of time. With these various advantages, soft-sided insulated containers are often preferable over containers with rigid walls.

While soft-sided insulated containers have many advantages, the very nature of the soft sides contributes to a number of problems as compared to rigid containers that need to be addressed. Most obviously, because the containers are formed of flexible materials rather than rigid materials, a whole new set of materials needs to be used for the container. Because the dimensions of the container are subject to the flexibility of the material, dimensions can change during use of the container, and many rigid structures (such as hinges, latches, locks etc.) are not possible.

For example, covers of soft-sided insulated containers cannot be formed for a tight (i.e., slight interference) fit into the body of the container. Instead, the tolerance associated with locational placement of the cover of a soft-side container is one or more orders of magnitude larger than with rigid containers. The uncertainty of locating the cover with respect to the container can lead to thermal problems including the escape of heat or cold from the container through gaps between the cover and the body of the container.

To secure the cover with respect to the body of the container, many soft-sided containers use a zipper connection between the cover and the body. As currently designed, zippers do not possess the thermal resistance needed for many applications. The zippered seam can create a location of significant thermal loss from the container.

The design of a soft-sided container needs to be efficient and inexpensive, from the standpoint of both the cost of materials and the amounts of materials used. The soft-sided container should also be easily manufactured and minimize the labor necessary to create the container.

BRIEF SUMMARY OF THE INVENTION

The present invention is a soft-sided insulative container including a base, a rear wall extending upward from the base, a plurality of peripheral side walls extending upward from the base, and a cover. The cover is integrally formed with the rear wall and connected to the rear wall with a folding hinge. Each side wall has a side wall ear flexibly attached thereto with a folding hinge. The side wall ears extend substantially around an entirety of the peripheral side walls. The cover has cover ears, each flexibly attached to the cover with a folding hinge. The cover ears extend substantially around an entirety of the peripheral edges of the cover. In this way, each unhinged edge between the cover and the peripheral side walls in a closed position includes both a side wall ear and a cover ear in an overlapping configuration. The base, the side walls, the cover, the side wall ears and the cover ears are formed of three layers of flexible material, including an inside layer, and outside layer, and a thermally insulative blanket. The inside layer and the outside layer are substantially waterproof. In one aspect, the insulation blanket includes a plurality of separate layers, which extend continuously through the flexible hinges, but do not extend into seams.

Figure 1:
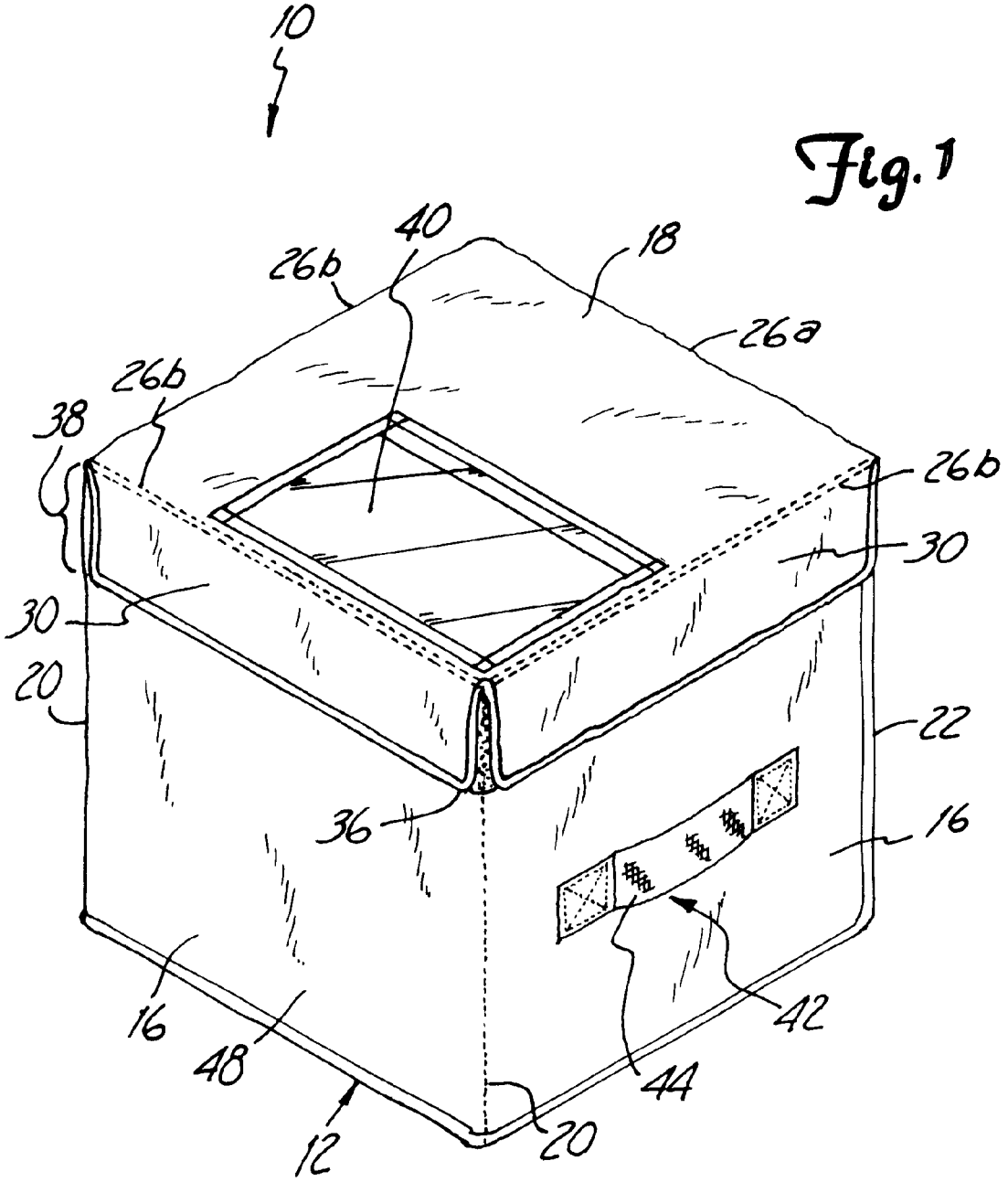
FIG. 1 is a perspective view of a soft-sided insulated container according to the present invention.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

A container 10 of the present invention generally includes a base 12, a rear wall 14, peripheral side walls 16, and a cover 18. The side walls 16 are continuous and provide continuous thermal insulation at front edges 20. The side walls 16 are also connected at rear edges 22 to the rear wall 14 to form an enclosure 24.

Figure 2:
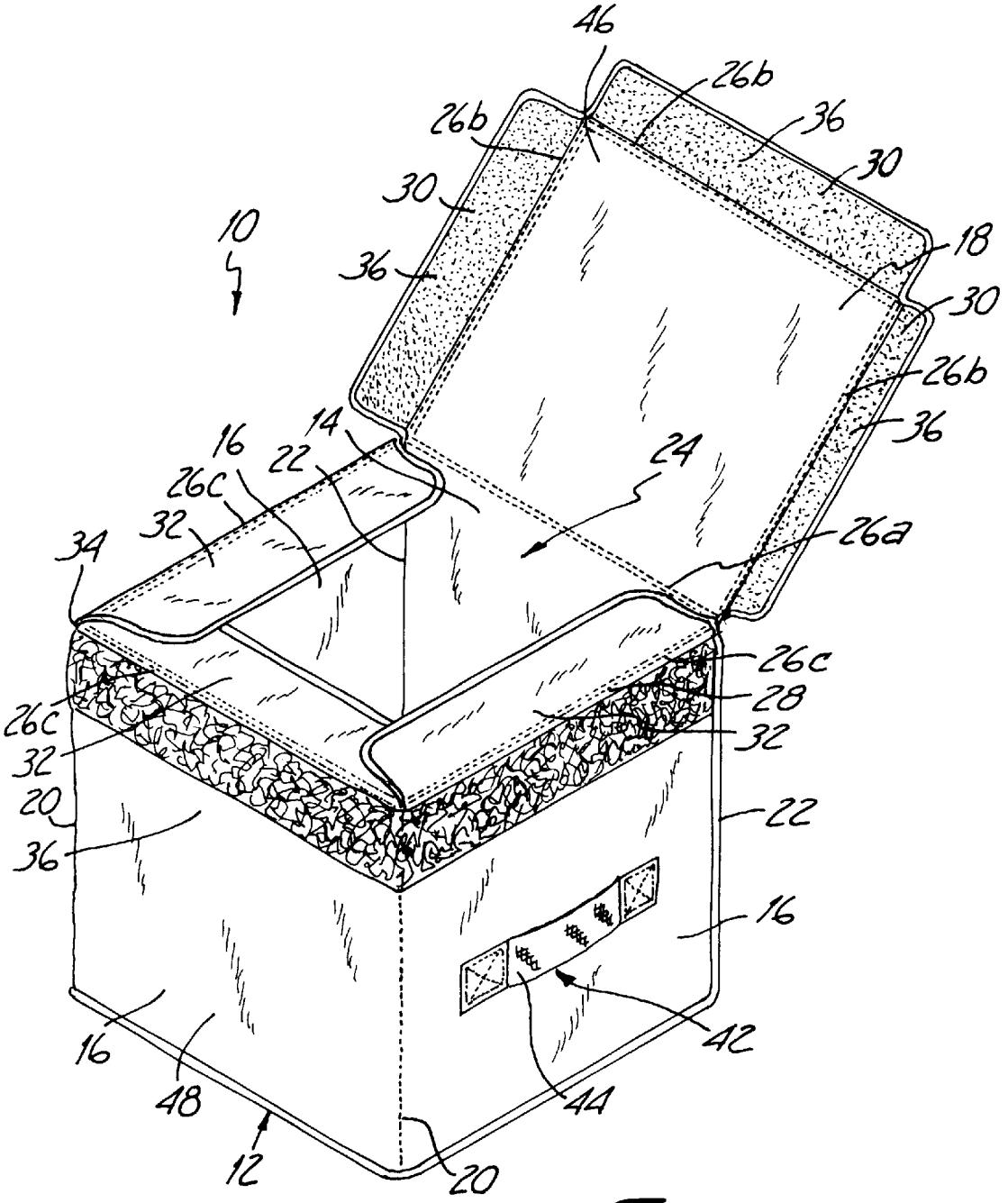
FIG. 2 is a perspective view of the container of FIG. 1 in an open position.

As shown in FIGS. 1 and 2, the container 10 can be commonly positioned so the base 12 is at the bottom of the container 10 with the rear wall 14 and side walls 16 extending upwardly, but the container 10 can be used in other orientations as well. In the preferred embodiment, there are three side walls 16, and each of the base 12, rear wall 14 and three side walls 16 are appropriately sized rectangles and generally at right angles (in perpendicular planes) to one another, so the container 10 has the shape of a box. The cover 18 is similarly rectangular and appropriately sized so the cover 18 in the closed position shown in FIG. 1 covers the enclosure 24. Most preferably, each of the base 12, the side walls 16, the rear wall 14 and the cover 18 are square, such that the entire container 10 in the closed position shown in FIG. 1 generally forms a cube. Workers skilled in the art will appreciate that many alternative shapes can be selected for any of the base 12, side walls 16, rear wall 14 and cover 18 to provide a closable container 10.

As shown by comparison between FIGS. 1 and 2, the cover 18 is attached to the rear wall 14 along a flexible folding hinge 26*a*. As will be further explained with reference to FIG. 9, each folding hinge 26 provides continuous thermal insulation. Other than the folding hinge 26*a*, the cover 18 is separate from the side walls 16 (that is, not directly connected with thermally insulative structure), leaving a thermally disconnected junction 28 defined at the top of the container 10 between the side walls 16 and the cover 18. For most prior art designs, this thermally disconnected junction between the side walls and the cover is a major source of thermal loss. Particularly for soft-sided containers, thermal loss at the thermally disconnected junction may be exacerbated by inaccurate placement of the cover relative to the side walls.

In the configuration shown, the thermally disconnected junction 28 is at the top of the container 10. Orienting the thermally disconnected junction 28 at the top of the container 10 is particularly beneficial for insulating cold items, because convection currents (or the absence thereof) tend to retain cold in the bottom of the container 10. For insulating hot items, other orientations may be useful. For instance, the container may be formed with more of a clamshell shape, which would lower the thermally disconnected junction relative to the enclosed space. Alternatively, the container 10 could be supported on a side or upside down, to change the location of the thermally disconnected junction 28 relative to the enclosed space 24.

Cover ears 30 are positioned along each of the open edges of the cover 18 other than the location of hinge 26*a*, that is, along substantially all of the thermally disconnected junction 28. Each of these cover ears 30 are attached to the cover 18 with a flexible folding hinge 26*b*. Preferably the cover ears 30 are integrally formed with the cover 18 to provide a continuous thermal insulation layer. The cover 18 should be slightly larger than the top opening, so the folding hinges 26*b* are just outside of, rather than on top of, the side walls 16. With this relationship and as shown in the closed position of FIG. 1, the cover ears 30 extend outward from the cover 18 to substantially enclose a top portion of the side walls 16. Alternatively, the cover could be slightly smaller than the top opening, so the cover ears in the closed position could be received within the enclosure 24 such that they extend parallel to the side walls 16.

The cover ears 30 should be sized to provide a significant thermal barrier outward and downward from the thermally disconnected junction 28. In particular, the cover ears 30 in the closed position should extend downward from the thermally disconnected junction 28 a sufficient distance that thermal resistance in a vertical direction between the side walls 16 and the cover ears 30 (by conduction and/or convection) is at least equivalent to thermal resistance in a horizontal direction through the side walls 16 and cover ears 30. Depending on the construction of the cover ears and whether and how the cover ears attach to the side walls 16, cover ears which extend downward a distance of at least about 1 inch may be suitable. In the preferred embodiment, the cover ears 30 extend downward about 4½ inches from the cover 18.

Side wall ears 32 are positioned along each of the open edges of the side walls 16, that is, along substantially all of the thermally disconnected junction 28. Each of these side wall ears 32 are attached to its side wall 16 with a flexible folding hinge 26*c*. Preferably the side wall ears 32 are integrally formed with the side walls 16 to provide a continuous thermal insulation layer. In the closed position of FIG. 1, the side wall ears 32 are preferably oriented inward from the side walls 16 to extend parallel to the cover 18 and in contact with the cover 18. Alternatively, if the cover ears in the closed position are received within the enclosure, the side wall ears may extend over the cover. In either configuration, substantially all of the thermally disconnected junction 28 is covered by both a side wall ear 32 and a cover ear 30 in an overlapping configuration. The side wall ears 32 preferably meet at the corners 34 and only slightly overlap.

The side wall ears 32 should be sized to provide a significant thermal barrier inward from the thermally disconnected junction 28. In particular, the side wall ears 32 in the closed position should extend horizontally inward from the thermally disconnected junction 28 a sufficient distance that thermal resistance in a horizontal direction between the cover 18 and the side wall ears 32 (by conduction and/or convection) is at least equivalent to thermal resistance in a vertical direction through the cover 18 and side wall ears 32. Depending on the construction of the side wall ears and whether and how the side wall ears attach to the cover 18, side wall ears which extend inward a distance of at least about 1 inch may be suitable. In the preferred embodiment, the side wall ears 32 extend horizontally inward about 4 inches from the side walls 16.

The container 10 preferably includes a structure to temporarily secure the cover 18 into the closed position. For instance, the cover ears 30 may be removably attachable to the side walls 16. Alternatively or in conjunction, the side wall ears 32 could be removably attachable to the cover 18. The preferred way of temporary attachment is through opposing strips 36 of hook and loop type fabric (such as VELCRO) on the cover ears 30 and on the side walls 16. The strips 36 allow an attachment which extends along substantially all of the thermally disconnected junction 28. Furthermore, the hook and loop type attachment 36 serves as thermal insulation along the side walls 16, minimizing thermal conduction and/or convection in a vertical direction between the side walls 16 and the cover ears 30.

The opposing mating strips 36 have a significant overlap 38 so as to attach the cover ears 30 to the side walls 16 in a temporary attachment which is both mechanically and thermally secure. The large overlap 38 is particularly important due to the deformable nature of the soft-sided container 10, as the cover 18 can be secured to the side walls 16 with a considerable locational error and still provide a physically and thermally secure attachment. With cover ears 30 that extend downward about 4½ inches, opposing mating strips 36 of about 4 inches wide on both the cover ears 30 and the side walls 16 can be used to provide the large overlap 38. While the hook and loop type attachment 36 provides very beneficial mechanical and thermal results, workers skilled in the art will appreciate that alternative attachment structures could be used at the thermally disconnected junction 28.

The container 10 should be large enough to enclose a substantial volume of items to be thermally insulated. For instance, an appropriate size includes a height of at least ten inches, a depth of at least one foot, and a width of at least one foot. In the preferred container 10, the interior width (left to right side wall 16) measurement is about 15½ inches, taken from the center of the left side wall 16 to the center of the right side wall 16 with each side wall 16 straight and not bulging. The interior depth (front to back) measurement is also about 15½ inches, taken from the center of the front side wall 16 to the center of the rear wall 14 with each side wall 16 straight. In the closed position, the interior height (cover 18 to base 12) measurement is also about 15½ inches taken from the center of the cover 18 to the center of the base 12, with the container 10 in the closed position so the cover 18 is flat, parallel to the base 12.

On the outside of the container 10 and preferably on the cover 18, a transparent document pouch 40 may be provided. The document pouch 40 may be about 11½" wide and 7½" high, to hold addressing information, packing slips, etc. (not shown). The document pouch 40 is preferably formed of 20 gauge clear vinyl. The document pouch 40 may be open on one side, or may have a temporary closure on one side such as a pocket with a hook and loop (VELCRO) attachment along the top edge.

The container 10 preferably includes at least one handle 42 for lifting and moving of the container 10. For instance, two handles 42 may be placed on opposite side walls 16. Alternatively, one handle may be placed on the rear wall 14 and a second handle on the front or middle side wall 16. The handles 42 should be securely attached to the container 10 and formed of strong materials to withstand the weight of items placed within the container 10, which for a large container can be substantial. For instance, the handles 42 may include hand grips 44 formed of 2 inch strips of a heavyweight polypropylene webbing. There should be some slack in the hand grips 44 to allow for easy grasping. For instance, 10½ inch long hand grips 44 may be sewn into a 10 inch long space. The hand grips 44 may be black to hide any dirt that gathers thereon.

As best shown in FIGS. 7–11, the container 10 is generally made from several layers of non-rigid, flexible material, including an inside layer 46 and an outside layer 48 and a thermally insulative blanket 50 between the inside layer 46 and the outside layer 48. However, the entire container 10 need not be made of flexible materials, and particularly structures which are placed between the inside and outside layers 46, 48 need not be flexible. Handle support plates 52 shown in FIG. 3 may be positioned interior to the outside layer 48, and each hand grip 44 may be attached through the outside layer 48 to its handle support plate 52. The preferred placement for the handle support plates 52 is outside the insulation blanket 50, between the insulation blanket 50 and the outside layer 48. Each hand grip 44 can be attached to the container 10 by sewing through the hand grip 44, the outside layer 48 and the handle support plate 52. The preferred material of the handle support plate 52 is rigid but permits sewing therethrough, such as a 220# polypropylene board.

The handle support plate 52 should be somewhat larger than the hand grip 44. For instance, with the hand grip 44 positioned in an 11 inch space, the handle support plate 52 may be 13 inches wide and 3 inches high. The handle support plate 52 serves to spread the transfer of force from the hand grip 44 to the container 10 to reduce stress and prevent tearing of the container 10. The handle support plate 52 should have amply radiused corners 54 such as a radius of about 0.25 inches or more, to avoid any poking or piercing of the flexible materials and further spread force transmitted. For instance, the corners 54 may have a 1 inch radius. The hand grips 44 may be sewn to the outside layer 48 and the handle support plate 52 using a Box X stitch, 1¼ inch wide and 1¾ inch high.

A rigid base plate 56 may be provided in the base 12, such as between the thermal insulated blanket 50 and the outside layer 48. The base plate 56 strengthens the base 12 of the container 10 and helps the container 10 to hold its shape, and may also add significant thermal insulation to the base 12. The added thermal insulation in the base 12 in a rigid form is particularly important when heavy, cold items are being stored, as heavy items will compress the thermal insulation blanket 50 in the base 12 and increase thermal conductivity therethrough. The base plate 56 should not absorb moisture to minimize the possibility of bacterial growth. For a container 10 of 15½ inch interior width and depth, the base plate 56 may be generally be a 15×15 inch square. The base plate 56 should have amply radiused corners 58 such as a radius of about 0.25 inches or more, to avoid any poking or piercing of the flexible materials, and to further spread the force transmitted. For instance, the corners 58 may have a 2 inch radius.

Figure 3:
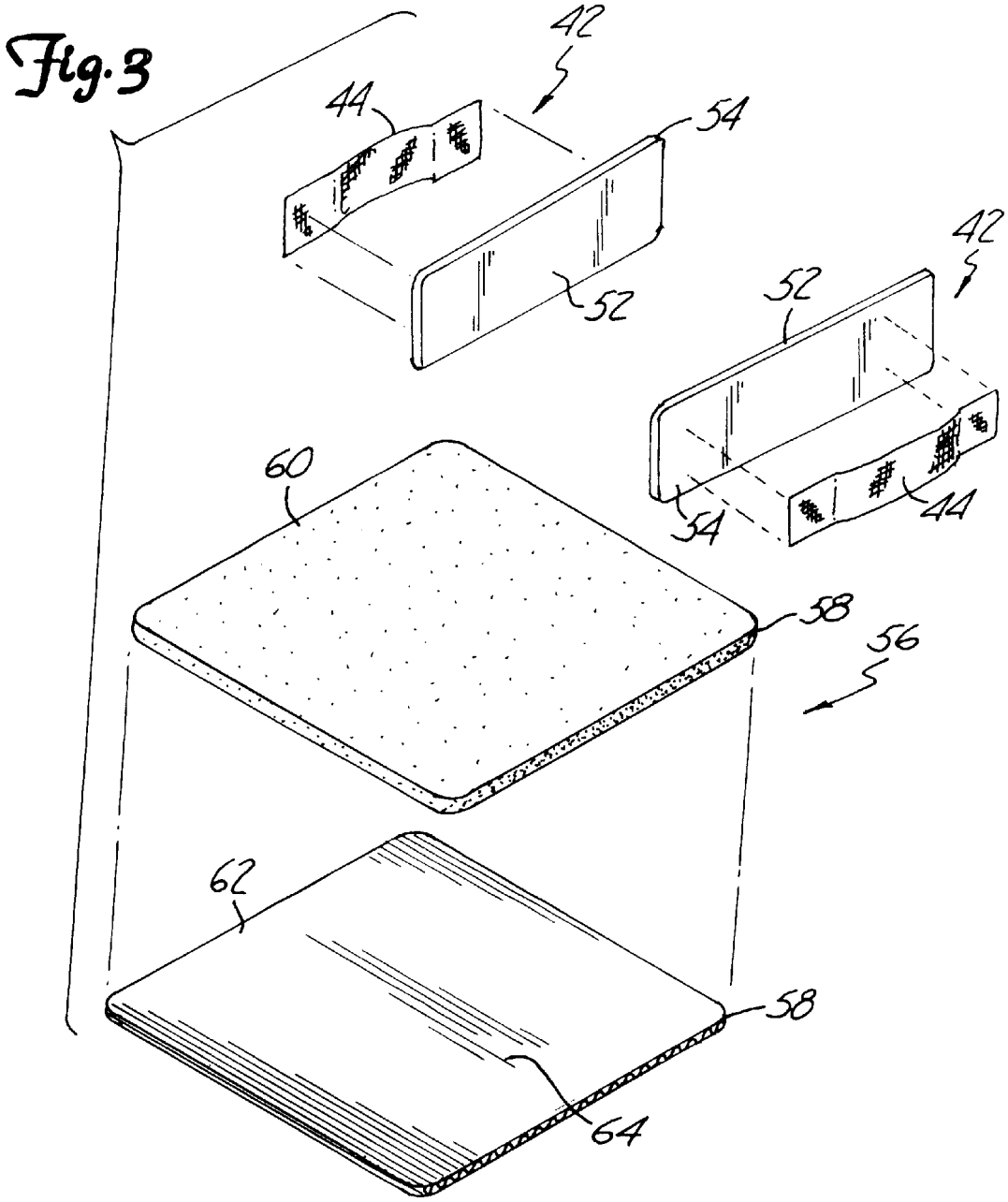
FIG. 3 is an exploded perspective view of the handle and base inserts of the container of FIG. 1.

As shown in FIG. 3, the base plate 56 may be formed from a rigid foam layer 60 and a corrugated layer 62. The foam layer 60 is selected to provide considerable thermal resistance, such as with a closed cell foam which is substantially uncompressed under the weight of items carried in the container 10. For instance, the foam layer 60 may be a polypropylene or polyethylene foam. The preferred foam layer 60 is a ½ inch thick foam board available as MICROFOAM MF-500 from AVI, Astro-Valcour, Inc. of Glens Fall, New York. This material has about 50,000 air cells per cubic inch and an R value of 3.7 per inch. The corrugated layer 62 may be 400# (minor insulation) double-face laminated corrugated high density polyethylene ("HDPE") or polypropylene from Diversi-Plast. Corrugation lines 64 of the corrugated layer 62 should run in the direction between handles 42 (i.e., for handles 42 on opposing side walls 16, parallel to the rear wall 14), which strengthens the corrugated layer 62 in this direction for transferring force from the base 12 toward the handles 42.

Figure 4:
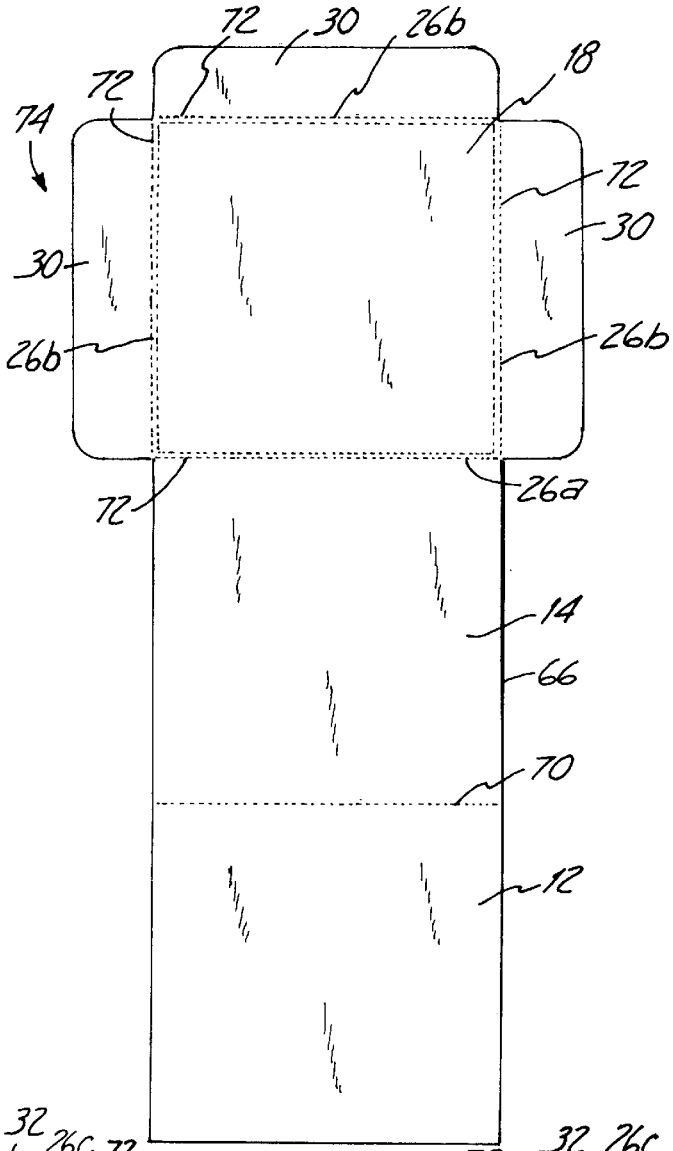
FIG. 4 is a schematic plan view of the base, rear wall and cover of the container of FIG. 1, showing seams and stitched hinge connections.
Figure 5:
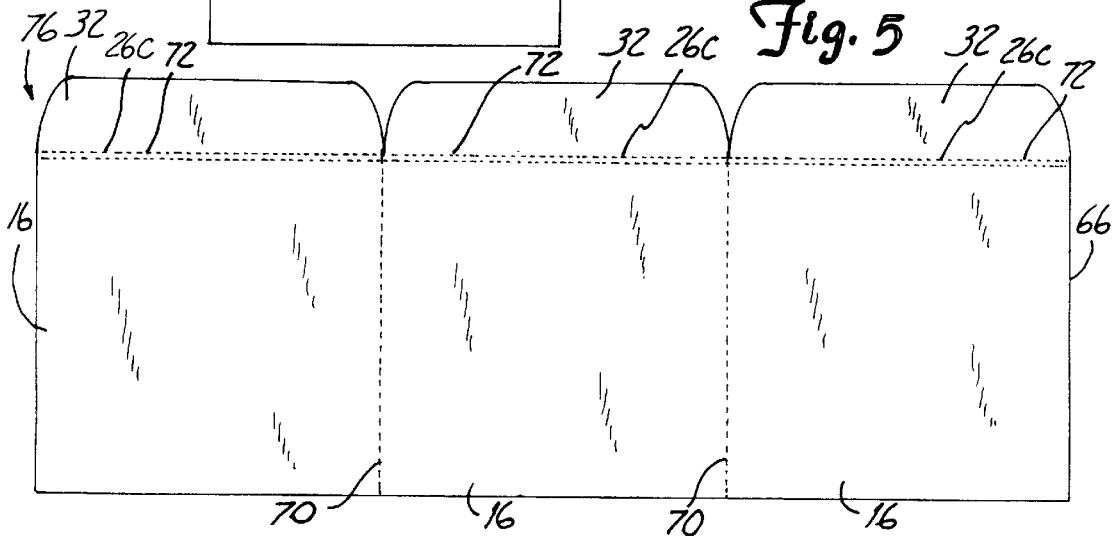
FIG. 5 is a schematic plan view of the side walls of the container of FIG. 1, showing seams and stitched hinge connections.
Figure 6:
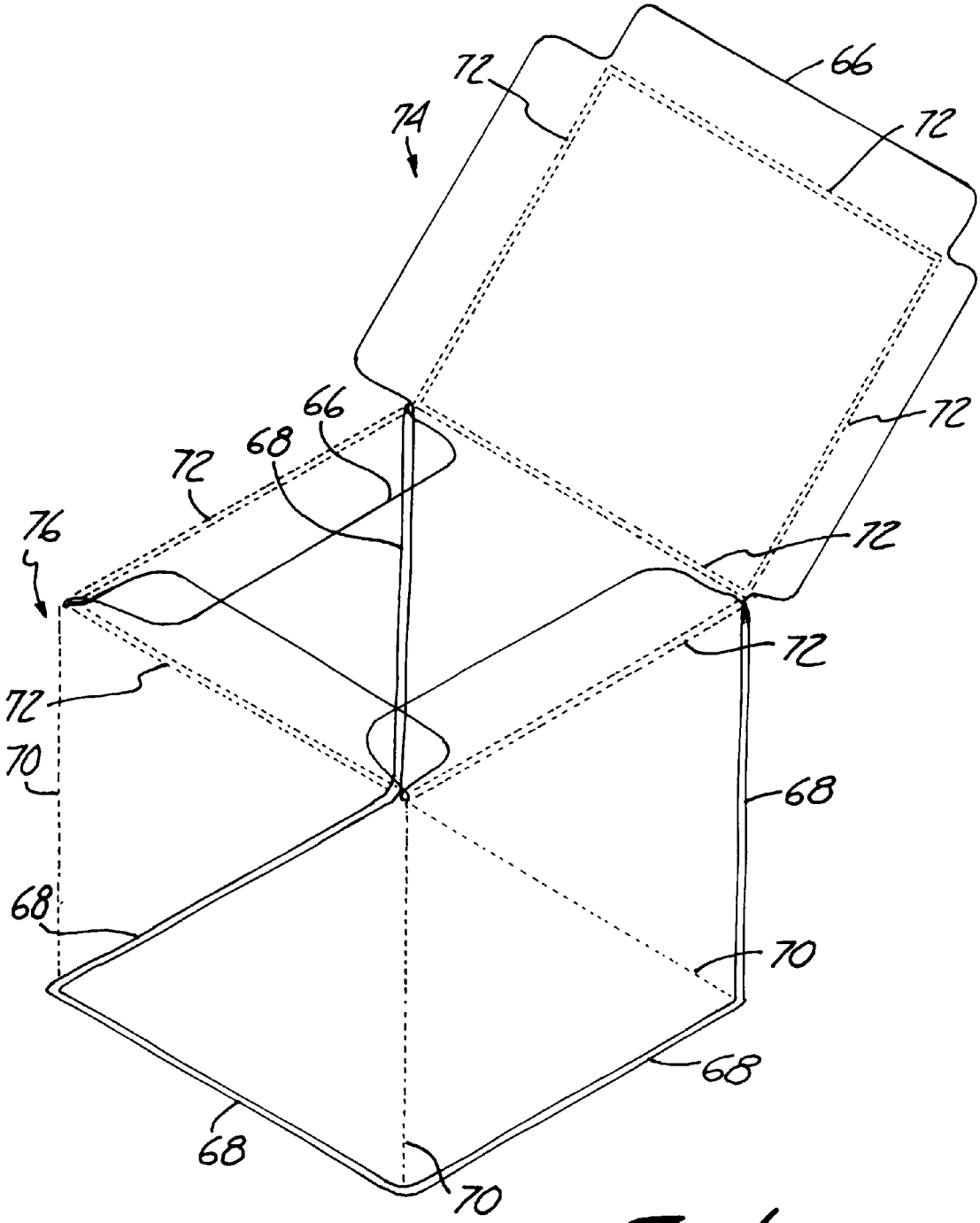
FIG. 6 is a schematic perspective view showing attachment of the pieces shown in FIGS. 4 and 5.

FIGS. 4–11 further detail the construction of the container 10. FIGS. 4–6 are schematics, in which solid lines are used for outside seams 66, 68, and in which dashed lines are used for threaded attachments 70, 72 through each of the layers 46, 48, 50. FIGS. 7–11 depict the seams 66, 68 and the threaded attachment 72 in cross-section and in more detail. For all the stitched or sewn connections 66, 68, 70, 72, the thread 73 used should be strong and non-absorbent. For instance, polyester or bonded nylon thread 73 of size 69 or T-70 may be used.

As shown in FIG. 4, the base 12, rear wall 14, cover 18 and cover ears 30 are all preferably integrally formed from a first set 74 of flat, flexible sheet material pieces having the outline shown. A single threaded attachment 70 serves as the edge between the base 12 and the rear wall 14. Double threaded attachments 72 serve to define the folding hinge 26*a* between the cover 18 and the rear wall 14 and the folding hinges 26*b* between the cover 18 and the cover ears 30. A seam 66 is provided around the entire periphery of the first set 74.

As shown in FIG. 5, all of the side walls 16 and the side wall ears 32 are preferably integrally formed from a second set 76 of flat, flexible sheet material pieces having the outline shown. Single threaded attachments 70 serve as the edges 20 between adjacent side walls 16. Double threaded attachments 72 serve to define the folding hinge 26*c* between each side wall 16 and its side wall ear 32. A seam 66 is provided around the entire periphery of the second set.

Both the first set 74 of FIG. 4 and the second set 76 of FIG. 5 are very nearly rectangular, and very nearly the same size. This helps to minimize scrap in cutting the sheet materials 46, 48, 50 to size.

FIG. 6 schematically shows bending of the first set 74 and second set 76 and attachment between the first set 74 and the second set 76. The seam 66 for the first set 74 and the seam 66 for the second set 76 are attached at two double seam connections 68 between the side walls 16 and the rear wall 14, and at three double seam connections 68 between the base 12 and the side walls 16.

As best shown in FIGS. 7–11, each of the base 12, the peripheral side walls 16, the cover 18, the plurality of side wall ears 32 and the plurality of cover ears 30 are formed of three separate layers: an inside layer 46, an outside layer 48, and a thermal insulation blanket 50. The inside layer 46 and the outside layer 48 are formed of a substantially waterproof material. The waterproof material should be easily cleaned to prevent any buildup of germs. The waterproof material also prevents any seepage of water into the thermal insulation blanket 50, which otherwise could cause a decrease in thermal efficiency, an increase in weight, bacterial growth, and rotting of the blanket 50.

The outside layer 48 is thermally insulated from the inside of the enclosure 24, and the outside layer 48 will not see the full hot and/or cold temperature of the contents of the container 10. However, the outside layer 48 will see the full hot and/or cold temperature of the environment where the container 10 is used, and the material selected for the outside layer 48 needs to be able to withstand these temperature differentials. For example, if the container 10 will be used outside and exposed to winter cold and/or summer heat, the material for the outside layer 48 should remain pliable at such temperatures and not become brittle or deteriorate.

The outside layer 48, at least for the side walls 16, the rear wall 14, the cover 18 and the cover ears 30, is preferably a reflective material. The reflective material minimizes radiation heating of the container 10. While reflective materials are typically more thermally conductive than non-reflective materials, the design of the cover ears 30 and the side wall ears 32 minimizes conductance, and the thermal improvement by minimizing radiation heating more than offsets the thermal loss due to increased conductance in the outside layer 48. The preferred reflective material is an 18 oz. reflective laminated "Energy Shield" fabric. Such reflective material is commercially available from Bruin Plastics Company of Glendale, Rhode Island in 54 inch and 62 inch widths.

The outside layer 48 for the base 12 will ordinarily be placed on a floor or shelf (not shown), and thus will not ordinarily receive radiation, but will be subject to additional wear. Accordingly, the outside layer 48 for the base 12 should be formed of a durable, waterproof material which minimizes thermal conduction. The preferred material is a vinyl coated polyester. For instance, a black 18 oz. German-made vinyl-coated polyester may be used, which should be flat to the bottom, not loose or bunched up. The black color helps to hide dirt on the bottom of the container 10.

The inside layer 46 should be formed of a waterproof material which minimizes thermal conduction. The inside layer 46 will not typically receive the level of wear of the outside layer 48 for the base 12, but should still be somewhat durable. In contrast to the outside layer 48, the inside layer 46 will be exposed to the full hot and/or cold temperature of the contents of the container 10, and the inside layer 46 must be able to withstand these temperature differences. For instance, a white 14 oz. Korean made vinyl-coated polyester available from Seattle Textile Company, of Seattle, Wash may be used for the inside layer 46. The preferred vinyl-coated polyester remains flexible down to at least −40° F., and does not melt or emit volatiles at temperatures up to at least 200° F. The white color allows the inside layer 46 to show any dirt or spills which could support bacterial growth, and thus facilitates cleaning of the inside layer 46.

The thermal insulation blanket 50 is preferably formed of a plurality of layers of thermally insulative, flexible sheet material. For instance, THINSULATE Type 50% CS200 50% C200 available from 3M of St. Paul, Minn. can be used as the thermally insulative, flexible sheet material. The preferred thermal insulation blanket 50 includes two outer layers 78 coated with scrim and two uncoated inner layers 80, for a total of four layers 78, 80.

Forming the thermal insulation blanket 50 out of a plurality of separate layers 78, 80 of sheet material provides several advantages. The separate layers 78, 80 give more and can move relative to each other. The relative movement possible between layers 78, 80 of sheet material helps at the double threaded attachment locations 72, making hinges 26 more flexible than they would be with a single layer of insulation material at a same overall thickness. The relative movement also makes the overall structure more flexible than if a single layer of insulation material at a same overall thickness was used. The multiple layers 78, 80 tend to space themselves at a very effective distance for efficient thermal insulation (similar to wearing multiple layers of appropriately fitting clothing), while at the same time permitting significant compression and deformation for the soft-sided container 10. Cutting and sewing is also easier through the multiple layers 78, 80 rather than a single layer of equivalent thickness.

Figure 7:
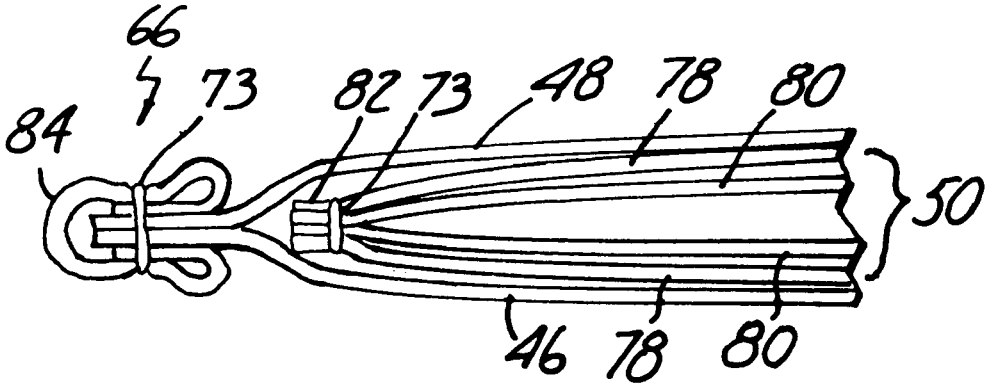
FIG. 7 is a cross-sectional view of an end seam of the container shown in FIG. 1.

FIG. 7 shows a cross-sectional view of an end seam 66 for the three layers 46, 48, 50 of material such as on the side wall ears 32 or on the cover ears 30. The multiple layers 78, 80 of insulation sheet material are attached together such as with thread 73 at a peripheral edge 82 to form the insulation blanket 50. The peripheral edge 82 of the insulation blanket 50 may extend as close as possible but not into the seam 66. For instance, the peripheral edge 82 of the insulation blanket 50 may extend to within ⅛ inch of the seam 66.

Figure 8:
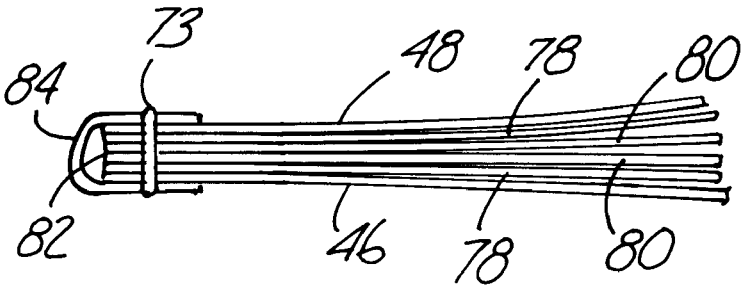
FIG. 8 is a cross-sectional view of an alternative end seam of the container shown in FIG. 1.

Alternatively as shown in FIG. 8, one or more or all layers 78, 80 of the insulative sheet material may extend into the seam 66. Extending the layers 78, 80 into the seam 66 prevents any bunching of the insulation blanket 50 or pulling of the insulation blanket 50 away from the seam 66.

The seam 66 is formed by attaching a binding material 84 around the edge of the inside and outside layers 46, 48 and insulation layers 78, 80. The binding 84 should be a strong, durable, flexible waterproof material, which allows sewing of the seams 66. The preferred material for binding 84 is a nylon strip or "tape" having a width of about 1 inch. The binding 84 may be folded and sewn with thread 73 into the clean finish edge configuration shown in FIGS. 7, 10 and 11. Alternatively, the binding 84 may have a woven edge which itself is resistant to fraying, and be provided as a raw edge configuration as shown in FIG. 8. For instance, the tape may have a grosgrain weave. The binding 84 may be sewn with thread 73 as shown to form an attractive and sturdy seam 66.

Figure 9:
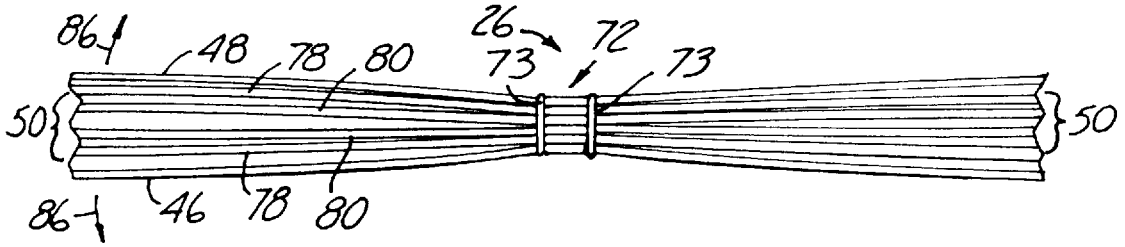
FIG. 9 is a cross-sectional view of a folding hinge location of the container of FIG. 1.

FIG. 9 shows how the preferred folding hinge 26 is created with the three layer construction. Hinges 26 are created using two rows of stitching 72 spaced slightly apart.

The rows of stitching 72 extend through the inside layer 46, the outside layer 48, and the insulation blanket 50. A preferred spacing for the rows of stitching 72 is ¼ inch apart. With this construction, the inside layer 46, the outside layer 48 and the insulation blanket 50 each extend continuously as unseamed sheet material across the hinge 26. The hinge 26 allows folding between the two portions as shown by arrows 86, while not providing a thermal discontinuity across the hinge 26.

The non-hinged middle edges, such as front edges 20 between adjacent side walls 16 and the edge between the base 12 and the rear wall 14 as shown in FIGS. 4–6, are formed similar to the folding hinge 26 of FIG. 9 but with only a single row 70 of stitching with thread 73. The single row 70 of stitching provides a location where the three layer construction can be bent into a corner edge, but does not provide the flexibility desired for a hinge 26. With this construction, the first set 74 of the inside layer 46, the outside layer 48 and the insulation blanket 50 each extend continuously as unseamed sheet material between the base 12, the rear wall 14 and the cover 18. The second set 76 of the inside layer 46, the outside layer 48 and the insulation blanket 50 each extend continuously as unseamed sheet material between all three side walls 16 and across front edges 20.

The thermal insulation blanket 50 thus extends continuously across the threaded attachments, both for the single threaded attachments 70 and the double threaded attachments 72. The continuous thermal insulation blanket 50 across these attachments minimizes thermal loss at these edges.

As an alternative to that shown in FIGS. 7–9, the hinge 26 can be used as a location to terminate one or more of the insulation layers 78, 80. For instance, the side wall ears 32 and/or cover ears 30 may be formed including only the two uncoated layers of insulation 80, with the two coated layers 78 terminating at the hinge (26*b* and/or 26*c*) for each ear (30 and/or 32). As another alternative, the side wall ears 32 and/or cover ears 30 may be formed including only one uncoated layer of insulation 80 and one coated layer 78, with the other uncoated layer 80 and the other coated layer 78 terminating at the hinge (26*b* and/or 26*c*) for each ear (30 and/or 32). Because two layers of the insulation sheet material extend unseamed through the hinge, the hinge still provides significant continuous thermal insulation, albeit not as much as the hinge of FIG. 9. Conversely, if less than all layers of insulation material 78, 80 extend to the peripheral edge 82, the peripheral edge 82 may be extended into the binding 84 with the inside layer 46 and the outside layer 48. Extending the peripheral edge 82 into the binding 84 precludes the possibility of bunching of the thermal insulation blanket 50 away from the binding 84.

Figure 10:
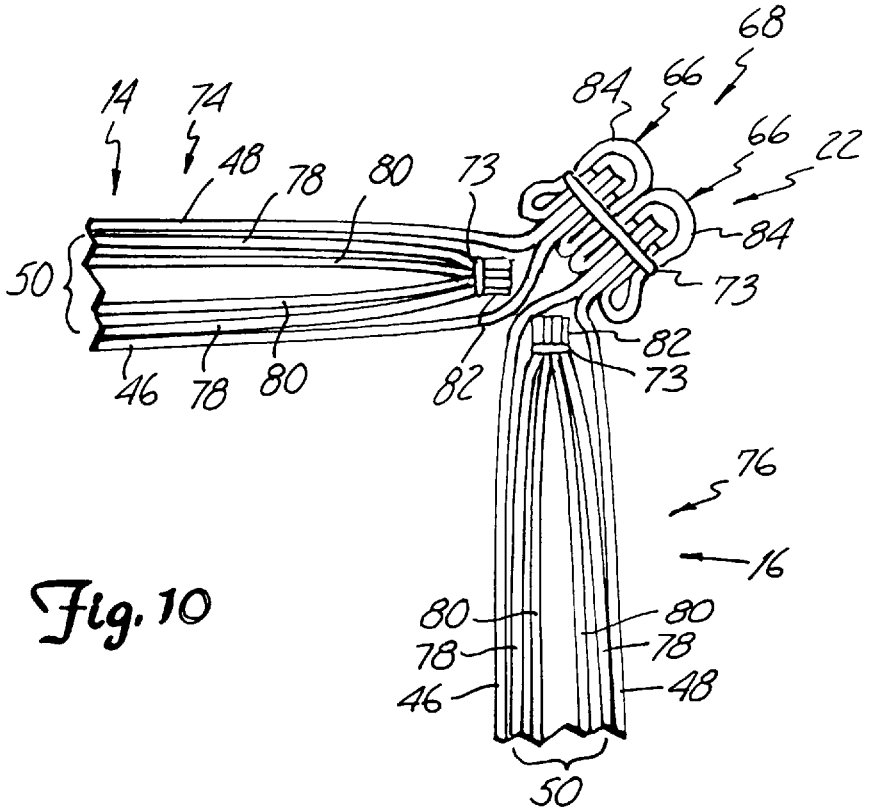
FIG. 10 is a cross-sectional view of a horizontal cut through a corner seam of the container of FIG. 1.
Figure 11:
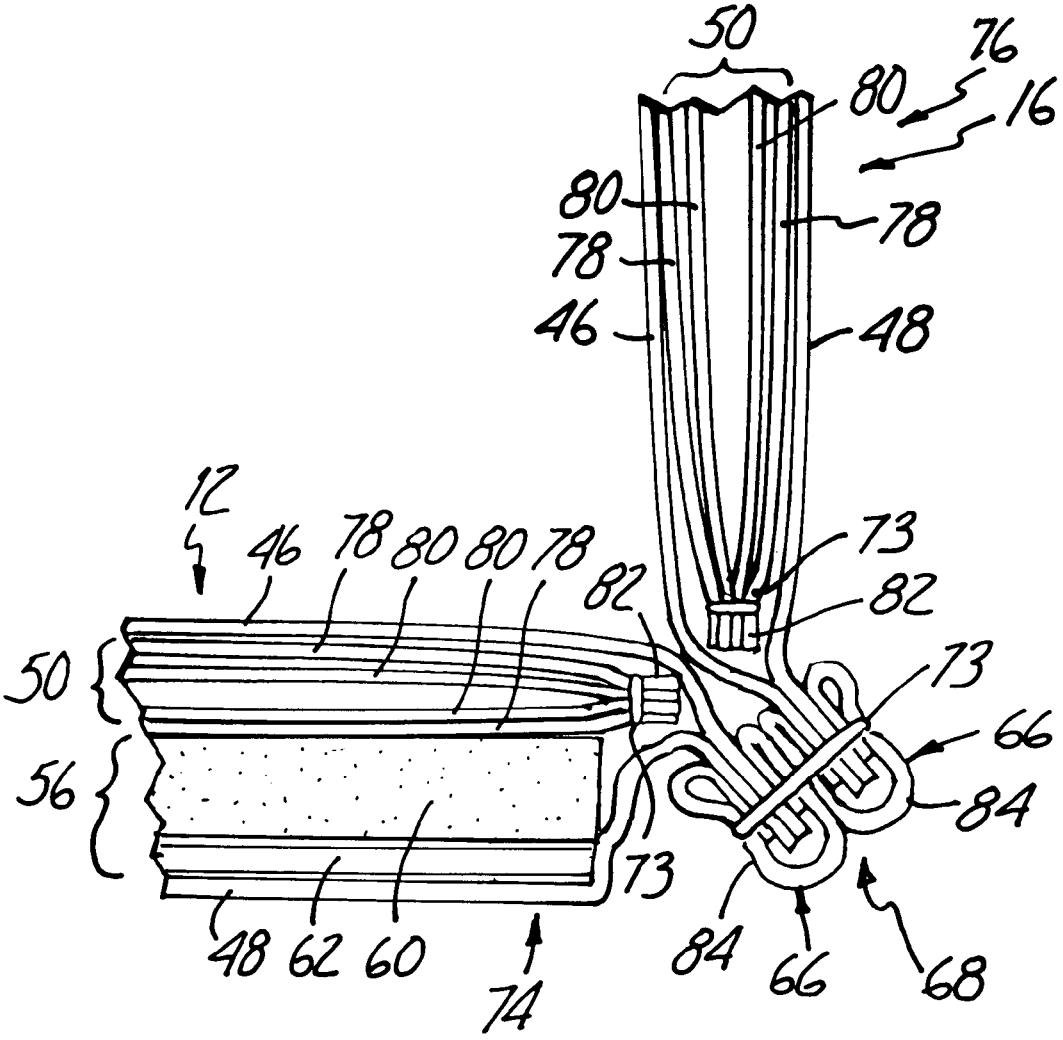
FIG. 11 is a cross-sectional view of a vertical cut of a bottom seam of the container of FIG. 1.

In the preferred construction, the binding 84 extends around the entire peripheries of both the first set 74 of FIG. 4 and the second set 76 of FIG. 5. The outside seam 66 (with binding 84), the double threaded attachments 72 for the hinges 26, and the single threaded attachments 70 for the edges 20 can thus all be sewn in a flat configuration without any folding of the first and second sets 74, 76. Subsequently, FIGS. 10 and 11 show how the first set 74 and second set 76 can be simply joined, by merely joining the bindings 84 of the two outside seams 66 such as by sewing into a double seam 68. Even if the insulation layers 78, 80 are extended into the seam 84 as shown in FIG. 8, the first set 74 and second set 76 can still be simply joined with a similar double seam (not shown).

As shown in FIG. 6, the double seam 68 of FIG. 10 extends vertically along two edges 22, to join the opposing side walls 16 to the rear wall 14 with two vertical double seams 68. The double seam 68 of FIG. 11 extends horizontally along three edges, to join each of the three side walls 16 to the base 12 with a double seam 68 which extends in two horizontal dimensions.

While a total of only five edges with double seams 68 are used, FIG. 6 shows that the double seams 68 extend in each of three dimensions, that is, vertically, horizontally depth-wise and horizontally width-wise. The binding 84 makes the seams 66 and particularly double seams 68 somewhat stiffer than non-seamed locations of the sheet materials 46, 48, 50, despite the fact that the insulation blanket 50 does not extend into the binding 84. Extending the double seams 68 in each of the three dimensions helps the container 10 to retain its shape despite being formed of generally flexible materials 46, 48, 50. However, because the single seams 66 and double seams 68 are not rigid and still allow folding relative to eachother, the container 10 retains its beneficial soft-sided attributes.

The front edges 20 of the peripheral side walls 16 are defined by vertical stitched connections 70 through the inside layer 46, the outside layer 48 and the insulation blanket 50. The folding hinges 26*c* between the peripheral side walls 16 and the side wall ears 32 are defined by double stitched connections 72 through the inside layer 46, the outside layer 48 and the insulation blanket 50 in both horizontal directions. That is, not only does the double seam 68 run in all three dimensions, but the stitched connections 70, 72 for the first set 74 also run in all three dimensions. These stitched connections 70, 72 hold the insulation blanket 50 to the full areal extent of the inside and outside layers 46, 48. Because of these stitched connections 70, 72 for the hinges 26*c* and the front edges 20, the insulation blanket 50 does not bunch up despite the fact that the insulation blanket 50 does not extend into the peripheral seam 66.

The folding hinge 26*b* between the cover 18 and the cover ears 30 is defined by a horizontal stitched connection 72 through the inside layer 46, the outside layer 48 and the insulation blanket 50 extending in the two horizontal dimensions. The folding hinge 26*a* between the cover 18 and the rear wall 14 is also defined by a horizontal stitched connection 72 through the inside layer 46, the outside layer 48 and the insulation blanket 50. These stitched connections 72 hold the insulation blanket 50 to the full areal extent of the cover 18 and the rear wall 14. While there is no stitching which holds the insulation blanket 50 to the full areal extent of the base 12, the base plate 56 holds and supports the insulation blanket 50 in a fully extended position.

Although the present invention has been described with reference to preferred embodiments, workers skilled in the art will recognize that changes may be made in form and detail without departing from the spirit and scope of the invention.

What is claimed is:

1. A soft-sided insulative container comprising:

a base;

a rear wall extending upward from the base;

a plurality of peripheral side walls extending upward from the base, the peripheral side walls connected at edges to the rear wall to form an enclosure having a top opening shape;

a cover integrally formed with the rear wall and connected to the rear wall with a folding hinge, the cover having unhinged peripheral edges in a shape matching the top opening shape such that the cover in a closed position covers the enclosure;

a plurality of side wall ears, each side wall ear flexibly attached with a folding hinge to one of the peripheral side walls such that the plurality of side wall ears extend substantially around an entirety of the peripheral side walls; and a plurality of cover ears each flexibly attached to the cover with a folding hinge, the plurality of cover ears extending substantially around an entirety of the peripheral edges of the cover, such that each unhinged edge between the cover and the peripheral side walls in a closed position includes both a side wall ear and a cover ear in an overlapping configuration;

wherein the soft-sided insulative container further comprises two handles attached on opposing sides of the soft-sided insulative container, each handle comprising:

a hand grip extending on the exterior of the outside layer of the soft-sided insulative container; and a support plate located between the inside layer and the outside layer and attached to the hand grip through the outside layer, the support plate formed of a rigid material;

wherein each of the base, the peripheral side walls, the cover, the plurality of side wall ears and the plurality of cover ears are formed of flexible material comprising:

an inside layer of a substantially waterproof material;

an outside layer of a substantially waterproof material; and an insulation blanket material disposed between the inside layer and the outside layer;

wherein the base, the rear wall and the cover are integrally formed such that the insulation blanket extends continuously through the base, the rear wall and the cover; and wherein the peripheral side walls are integrally formed such that the insulation blanket extends continuously through each of the peripheral side walls.

2. The soft-sided insulative container of claim 1, wherein each of the cover ears is integrally formed with the cover such that the inside layer, the outside layer and the insulation blanket extend continuously as unseamed sheet material from the cover to the cover ears.

3. The soft-sided insulative container of claim 1, wherein each of the side wall ears is integrally formed with the peripheral side walls such that the inside layer, the outside layer and the insulation blanket each extend continuously as unseamed sheet material from the peripheral side walls to the side wall ears.

4. The soft-sided insulative container of claim 1, wherein the peripheral side walls are integrally formed such that the inside layer, the outside layer and the insulation blanket each extend continuously as unseamed sheet material through each of the peripheral side walls;

wherein the peripheral side walls are connected to the base with a horizontal seam which extends in two horizontal dimensions;

wherein the peripheral side walls are connected to the rear wall with a vertical seam which extends vertically;

wherein the folding hinge between the cover and the cover ears is defined by a horizontal stitched connection through the inside layer, the outside layer and the insulation blanket extending in said two horizontal dimensions;

wherein the folding hinge between the cover and the rear wall is defined by a horizontal stitched connection through the inside layer, the outside layer and the insulation blanket;

wherein adjoining edges of the peripheral side walls are defined by vertical stitched connections through the inside layer, the outside layer and the insulation blanket; and wherein the folding hinges between the peripheral side walls and the side wall ears are defined by horizontal stitched connections through the inside layer, the outside layer and the insulation blanket.

5. The soft-sided insulative container of claim 1, wherein the cover ears comprise a fastener for temporary attachment to the peripheral side walls to temporarily secure the cover in a closed position.

6. The soft-sided insulative container of claim 1, wherein the base, the rear wall, the cover, and each of the peripheral side walls are rectangular and extend generally in perpendicular planes to define an enclosure having a box shape.

7. The soft-sided insulative container of claim 1, wherein the soft-sided insulative container has a height of at least ten inches, a depth of at least one foot, and a width of at least one foot.

8. The soft-sided insulative container of claim 1, wherein the support plate has radiused corners of radius of about 0.25 inches or more.

9. The soft-sided insulative container of claim 1, further comprising a base plate located in the base between the inside layer and the outside layer, the base plate formed of a rigid material.

10. The soft-sided insulative container of claim 9, wherein the base plate has radiused corners of radius of about 0.25 inches or more.

11. The soft-sided insulative container of claim 9, further comprising two handles attached on opposing sides of the soft-sided insulative container, wherein the base plate is formed of a corrugated material having corrugations running generally perpendicular to said opposing sides of the soft-sided insulative container.

12. The soft-sided insulative container of claim 1, wherein the insulation blanket comprises a plurality of layers of insulative sheet material.

13. The soft-sided insulative container of claim 1, wherein the outside layer of each of the rear wall, the peripheral side walls, and the cover is formed of a reflective material, and wherein the inside layer of each of the rear wall, the peripheral side walls and the cover is formed of a non-reflective material.

14. A soft-sided insulative container comprising:

a base;

a rear wall extending upward from the base;

a plurality of peripheral side walls extending upward from the base, the peripheral side walls connected at edges to the rear wall to form an enclosure having a top opening shape;

a cover integrally formed with the rear wall and connected to the rear wall with a folding hinge, the cover having unhinged peripheral edges in a shape matching the top opening shape such that the cover in a closed position covers the enclosure;

a plurality of side wall ears, each flexibly attached to one of the peripheral side walls; and a plurality of cover ears each flexibly attached to the cover;

wherein each of the base, the peripheral side walls, the cover, the plurality of side wall ears and the plurality of cover ears are formed of flexible material comprising:

an inside layer of a substantially waterproof material;

an outside layer of a substantially waterproof material; and an insulation blanket material disposed between the inside layer and the outside layer, the insulation blanket comprising a plurality of layers of insulative sheet material; and two handles attached on opposing sides of the soft-sided insulative container, each handle comprising:

a hand grip extending on the exterior of the outside layer of the soft-sided insulative container; and a support plate located between the inside layer and the outside layer and attached to the hand grip through the outside layer, the support plate formed of a rigid material.

15. The soft-sided insulative container of claim 14, wherein the insulation blanket comprises four layers of insulative sheet material, wherein the outside layer of each of the rear wall, the peripheral side walls, and the cover is formed of a reflective material, and wherein the inside layer of each of the rear wall, the peripheral side walls and the cover is formed of a non-reflective material.

* * * * *